US006217354B1

(12) United States Patent
Fencl et al.

(10) Patent No.: US 6,217,354 B1
(45) Date of Patent: Apr. 17, 2001

(54) LEVER TYPE ELECTRICAL CONNECTOR

(75) Inventors: Duane M. Fencl, Countryside; Thomas G. Premo, Downers Grove, both of IL (US)

(73) Assignee: Molek Incorporated, Lisle, IL (US)

( * ) Notice: Subject to any disclaimer, the term of this patent is extended or adjusted under 35 U.S.C. 154(b) by 0 days.

(21) Appl. No.: 09/528,629

(22) Filed: Mar. 20, 2000

(51) Int. Cl.[7] ..... H01R 13/62; H01R 13/627
(52) U.S. Cl. ..... 439/157; 439/347; 439/372
(58) Field of Search ..... 439/157, 372, 439/374, 347

(56) References Cited

U.S. PATENT DOCUMENTS 5,681,175 * 10/1997 Busse et al. ..... 439/157
5,938,458 8/1999 Krehbiel et al. ..... 439/157

* cited by examiner

*Primary Examiner*—Paula Bradley
*Assistant Examiner*—James Harvey
(74) *Attorney, Agent, or Firm*—Stacey E. Caldwell

(57) ABSTRACT

A lever type electrical connector assembly includes a first connector having an actuating lever pivotally movably mounted thereon. The actuating lever includes a first cam groove formed therein. A slide member is linearly movably mounted on the first connector and includes a second cam groove formed therein. The slide member has a first cam follower projection engaged in the first cam groove of the actuating lever, whereby pivotal movement of the actuating lever relative to the first connector effects linear movement of the slide member relative to the first connector. A second connector has a second cam follower projection to be engaged in the second cam groove of the slide member, whereby the connectors are mated and unmated in response to rotation of the actuating lever and resulting translation of the slide member.

16 Claims, 6 Drawing Sheets

LEVER TYPE ELECTRICAL CONNECTOR

FIELD OF THE INVENTION

This invention generally relates to the art of electrical connectors and, particularly, to an electrical connector having a lever whereby mating and unmating of the connector with a second connector is effected by rotation of the lever.

BACKGROUND OF THE INVENTION

A typical lever type electrical connector assembly includes a first connector which has an actuating lever rotatably mounted thereon for connecting and disconnecting the connector with a complementary mating second connector. The actuating lever and the second connector typically have a cam groove/cam follower arrangement for drawing the second connector into mating condition with the first connector in response to rotation of the lever.

A common structure for a lever type electrical connector of the character described above is to provide a generally U-shaped lever structure having a pair of lever arms which are disposed on opposite sides of the first ("actuator") connector. The lever arms may have cam grooves for engaging cam follower projections or posts on opposite sides of the second ("mating") connector.

Such lever type connectors often are used where large forces are required to mate and unmate a pair of connectors. For instance, terminal and housing frictional forces encountered during connecting and disconnecting the connectors may make the process difficult to perform by hand. The present invention is directed to solving various problems with such connectors, including providing a system for increasing the forces available for mating and unmating the connectors. In addition, the system of the invention solves the problem of the connectors rocking or skewing during mating and unmating.

SUMMARY OF THE INVENTION

An object, therefore, of the invention is to provide a new and improved lever type electrical connector assembly.

In the exemplary embodiment of the invention, a first connector pivotally mounts an actuating lever which includes a first cam groove formed therein. A slide member is linearly movably mounted on the first connector and includes a second cam groove formed therein. The slide member has a first cam follower projection engaged in the first cam groove of the actuating lever. Therefore, pivotal movement of the actuating lever relative to the first connector effects linear movement of the slide member relative to the first connector. A second connector has a second cam follower projection to be engaged in the second cam groove of the slide member, whereby the connectors are mated and unmated in response to rotation of the actuating lever and resulting translation of the slide member.

As disclosed herein, the actuating lever comprises one actuating arm of a generally U-shaped lever structure having a pair of actuating arms pivotally mounted on opposite sides of the first connector. Correspondingly, a pair of the slide members are provided on opposite sides of the first connector. Each slide member includes a pair of the second cam grooves spaced laterally of the mating direction of the connectors and engageable by a pair of the second cam follower projections on the second connector. The first connector includes a housing and a support wall spaced outwardly of each side of the housing, with the actuating arms and slide members disposed therebetween.

Another feature of the invention includes complementary interengaging polarizing means between the slide members and the first connector to ensure that the proper slide member is mounted on the proper side of the first connector. In the preferred embodiment, the polarizing means comprise tongue -and-groove means of different sizes.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
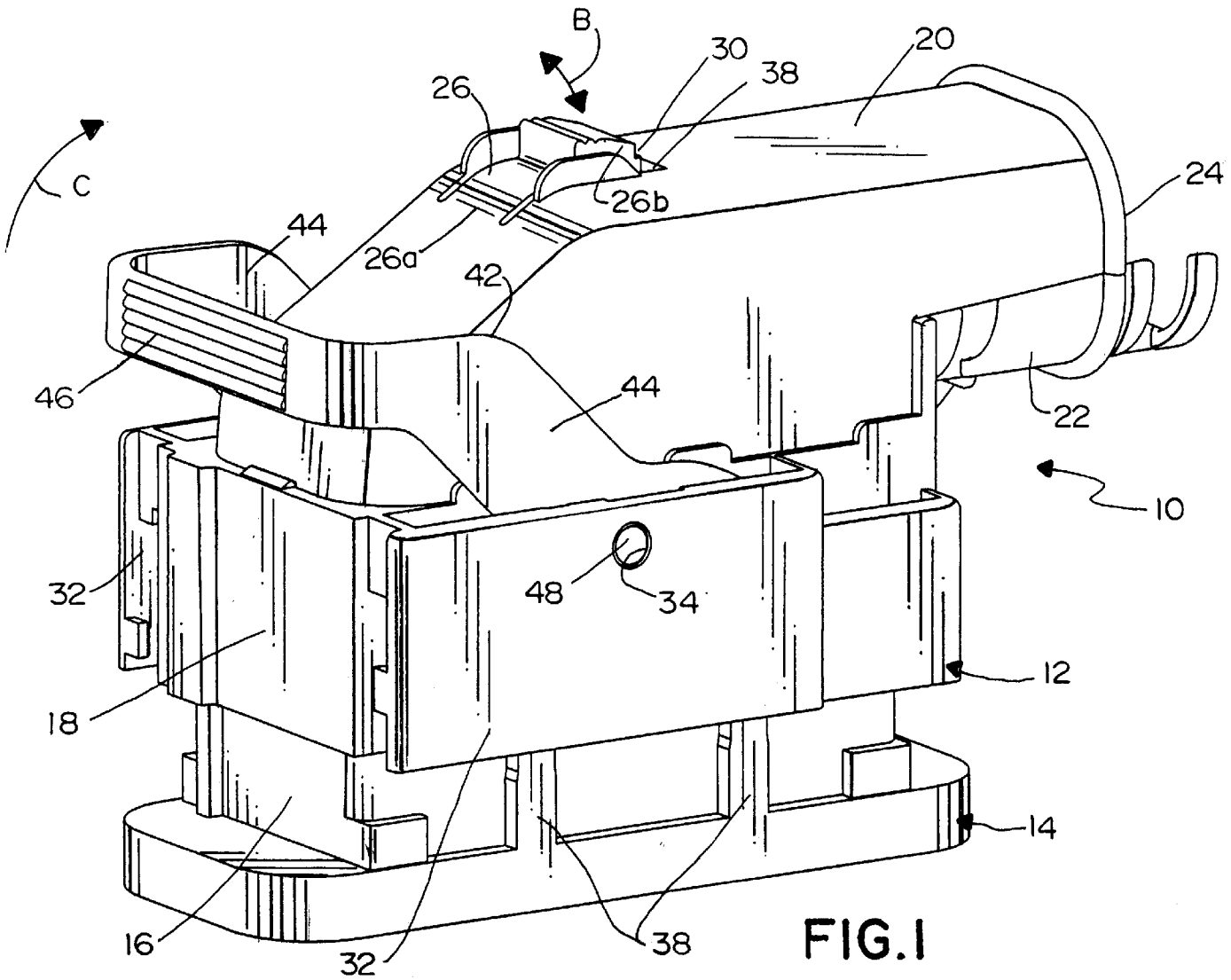
FIG. 1 is a perspective view of a lever type electrical connector assembly according to the invention, with the first and second connectors in a pre-mated position.
Figure 2:
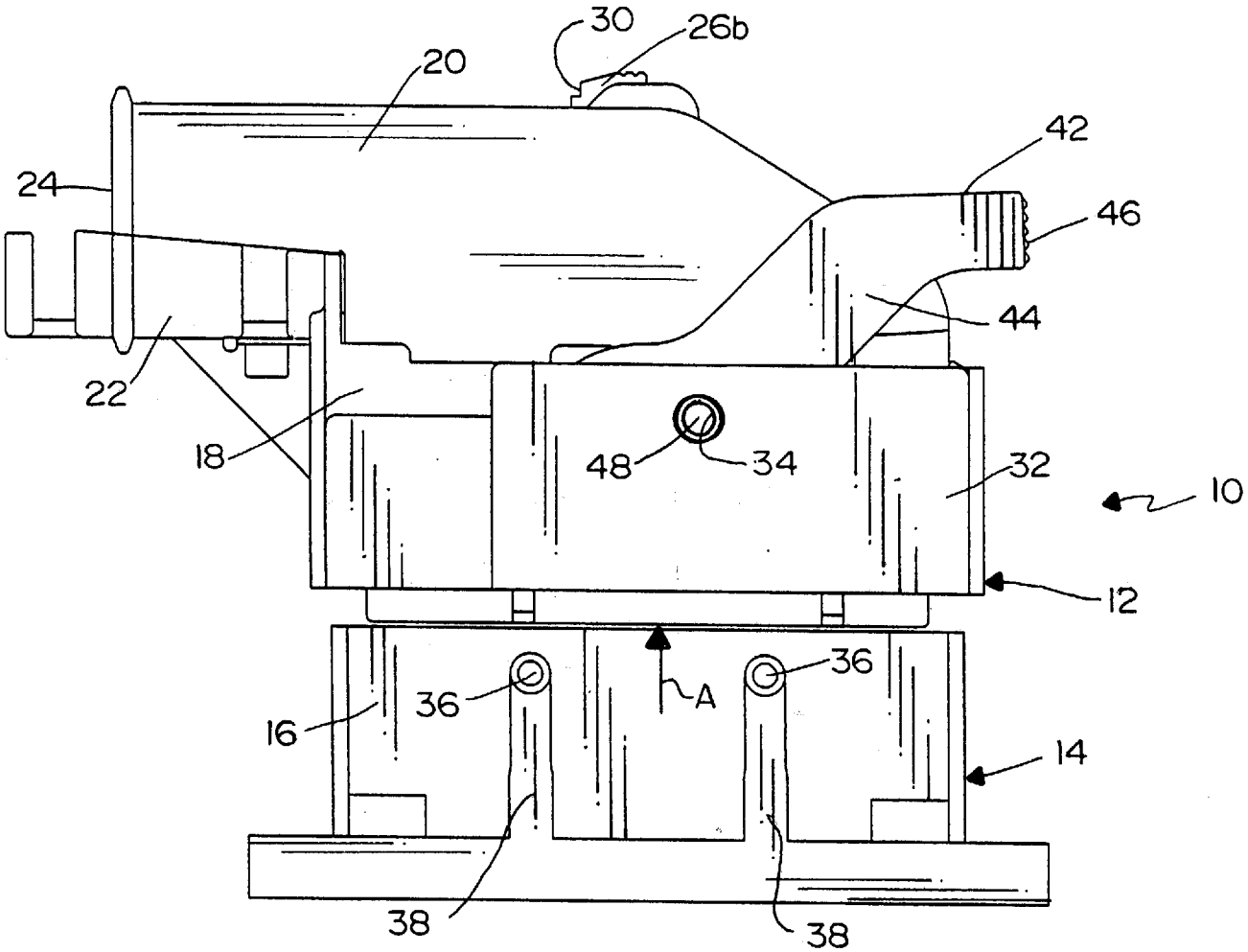
FIG. 2 is a side elevational view of the connector assembly, with the connectors separated prior to the pre-mated position.
Figure 3:
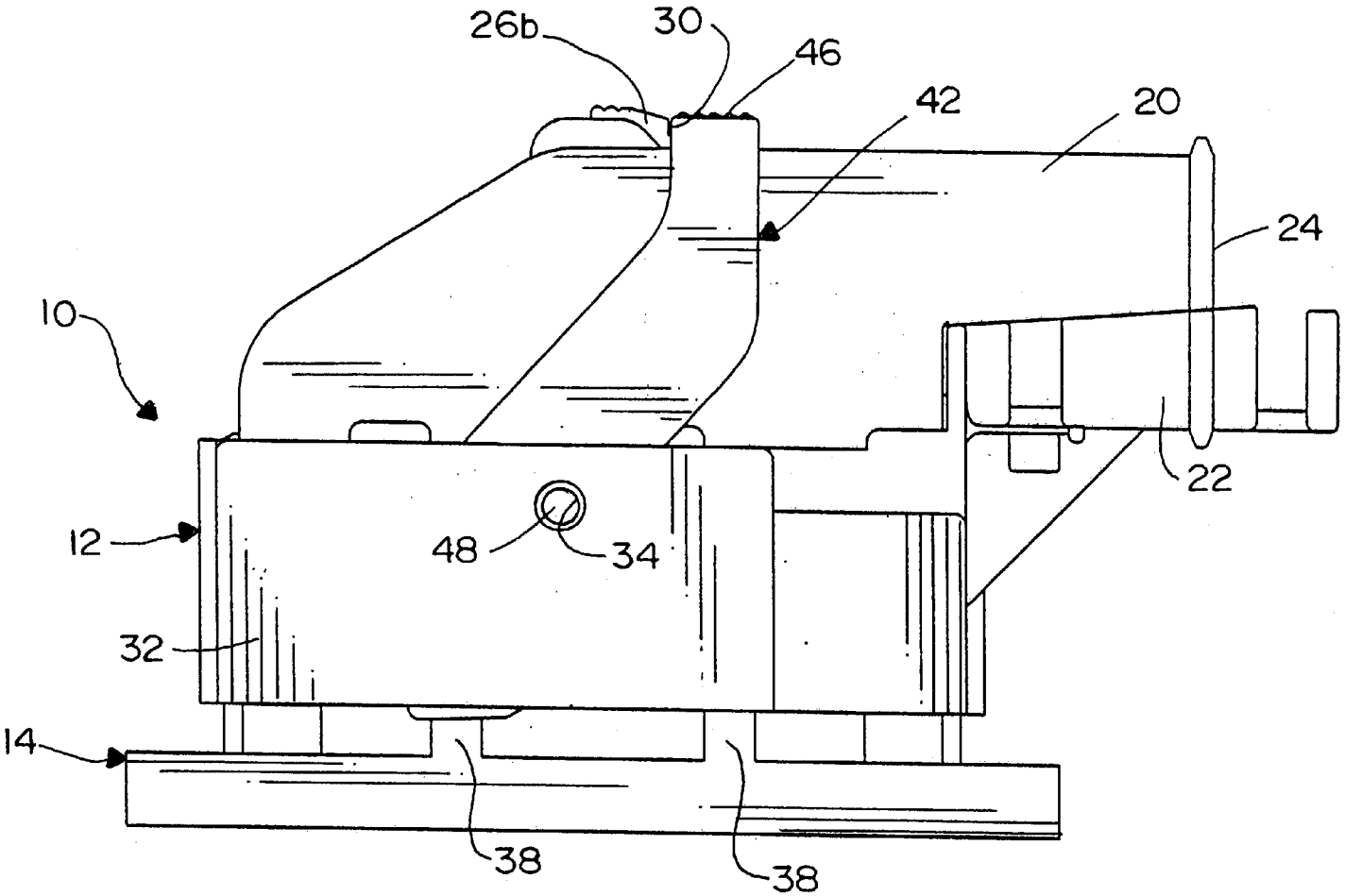
FIG. 3 is a side elevational view of the connector assembly, with the connectors fully mated.

Referring to the drawings in greater detail, and first to FIGS. 1–3, the invention is embodied in a lever type electrical connector assembly, generally designated 10. The assembly includes a first ("actuator") connector, generally designated 12, and a second ("mating") connector, generally designated 14. The connectors are shown separated in FIG. 2, in a pre-mated position in FIG. 1 and in a fully mated position in FIG. 3.

Mating connector 14 includes a molded plastic housing 16 which is inserted into a molded plastic housing 18 of actuator connector 12 when the connectors are mated in the direction of arrow "A" (FIG. 2). The actuator connector mounts a plurality of terminals which make contact with a plurality of terminals mounted in the mating connector. The terminals are not visible in the drawings, but they may comprise typical pin-and-socket or male-and-female terminals or other configurations. Further details of actuator connector 12 and mating connector 14 and their respective terminal arrangements will not be described herein, because the invention is applicable for a wide variety or range of electrical connector configurations.

Actuator connector 12 includes a shroud 20 which substantially covers the top thereof and combines with a bracket portion 22 of housing 18 to provide an opening 24 for ingress/egress of an electrical cable having conductors terminated to the terminals within the connector housing. A flexible latch arm 26 is integral with the shroud at a proximal end 26*a* of the arm. A distal end 26*b* of the latch arm is movable within a cutout 28 in the shroud, in the direction of double-headed arrow "B" (FIG. 1). The distal end of the latch arm has a raised portion to define a latch shoulder 30. Shroud 20 may be a separate component, such as of molded plastic material, appropriately assembled to the top of housing 18 of the actuator connector. The housing has a support wall 32 on each opposite side thereof and spaced outwardly from the housing. Each support wall includes a pivot journal in the form of a hole 34.

As best seen in FIG. 2, housing 16 of mating connector 14 has a pair of cam follower projections or posts 36 which project outwardly from each opposite side thereof. The posts are spaced laterally of mating direction "A". A molded support rib 38 leads from and is integral with each cam follower post 36. The support ribs extend in the mating direction of the connectors as indicated by arrow "A". Housing 16, cam follower posts 36 and support ribs 38 all are unitarily molded of plastic material. The ribs provide support for the posts to prevent breakage of the posts.

Figure 5:
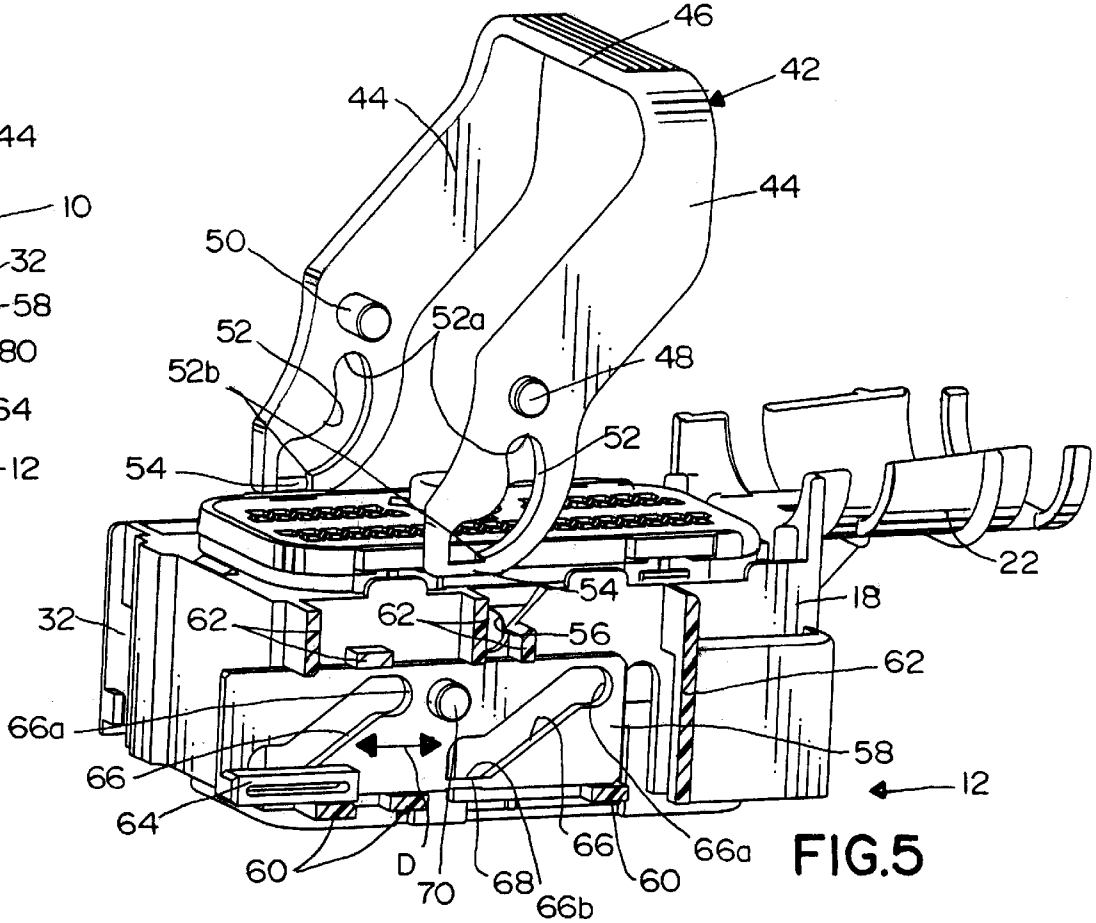
FIG. 5 is a perspective view of the actuator connector with the shroud removed, with the lever structure lifted off of the housing and with the outer side wall of the housing broken away to facilitate the illustration.
Figure 4:
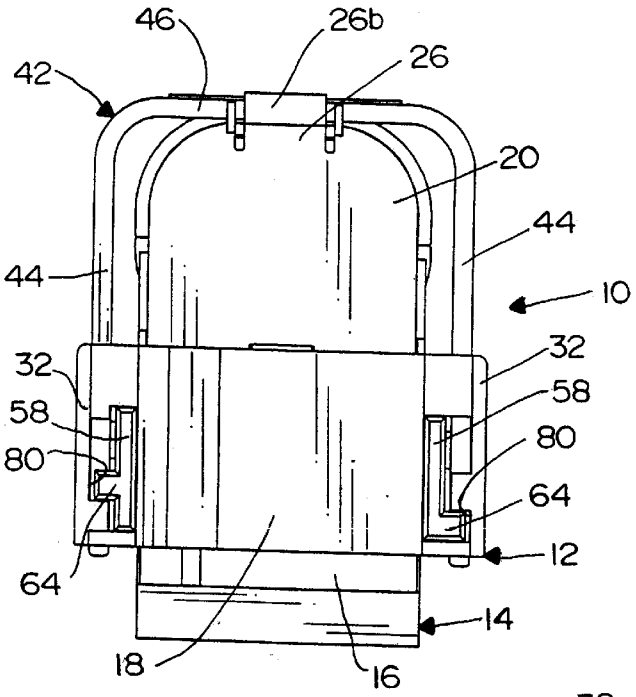
FIG. 4 is an end elevational view of the connector assembly looking toward the left-hand end of FIG. 3.

Referring to FIG. 5 in conjunction with FIGS. 1–4, a generally U-shaped lever structure, generally designated 42, is pivotally mounted on housing 18 of actuator connector 12. The lever structure is rotatable upwardly in the direction of arrow "C" (FIG. 1) to draw mating connector 14 into mated condition with the actuator connector. The U-shaped lever structure defines a pair of actuating arms 4.4 joined by a cross portion 46 which generally spans the width of the actuator connector. Each actuating arm has a pivot boss 48 on the outside thereof and a pivot boss 50 on the inside thereof. Each arm has an eccentric, arcuate cam groove 52 which extends from a closed end 52*a* to an open mouth 52*b*. A detent rib 54 extends across the open mouth. As clearly seen in FIG. 5, open mouth 52*b* of each cam groove 52 is at a greater radius from pivot bosses 48/50 than closed end 52*a* of the groove.

The free ends of actuating arms 44 of lever structure 42 are sandwiched between support walls 32 and housing 18 of the actuator connector. Outside pivot bosses 48 of the actuating arms project into pivot holes 34 in the support walls as best seen in FIG. 1. Inside pivot bosses 50 of the actuator arms project into pivot holes 56 in housing 18 as best seen in FIG. 5. Therefore, separate and independently interengaging pivots are provided between each actuating arm of the lever structure and the housing of the actuator connector on both the inside and the outside of the respective actuating arm. This prevents the two actuating arms of the U-shaped lever structure from spreading apart or moving outwardly of the connector housing during actuation and when encountering significant mating forces.

Still referring primarily to FIG. 5, a slide member 58 is linearly movably mounted on each opposite side of actuator connector 12 between outwardly spaced support walls 32 and housing 18 of the connector. Each slide member is a generally rectangular, elongated plate-like member which is slidable in a direction indicated by double-headed arrow "D", i.e., generally perpendicular to the mating direction of the connectors. A plurality of bottom spacer bars 60 and a plurality of top spacer bars 62 are molded integrally between support walls 32 and housing 18 to define channels therebetween within which the slide members are linearly movable. Each slide member has a polarizing rib 64 for purposes to be described in greater detail hereinafter.

Each slide member 58 includes a pair of cam grooves 66 formed therein. The cam grooves are oblique to the mating direction "A" of the connectors as well as the sliding direction "D" of the slide member. The cam grooves are spaced laterally of the mating direction. Each cam groove extends from a closed end 66*a* to an open mouth 66*b*. A detent rib 68 extends across the open mouth. Finally, a cam follower projection 70 projects outwardly from each slide member 58 between cam grooves 66 near the closed ends thereof.

Figure 6:
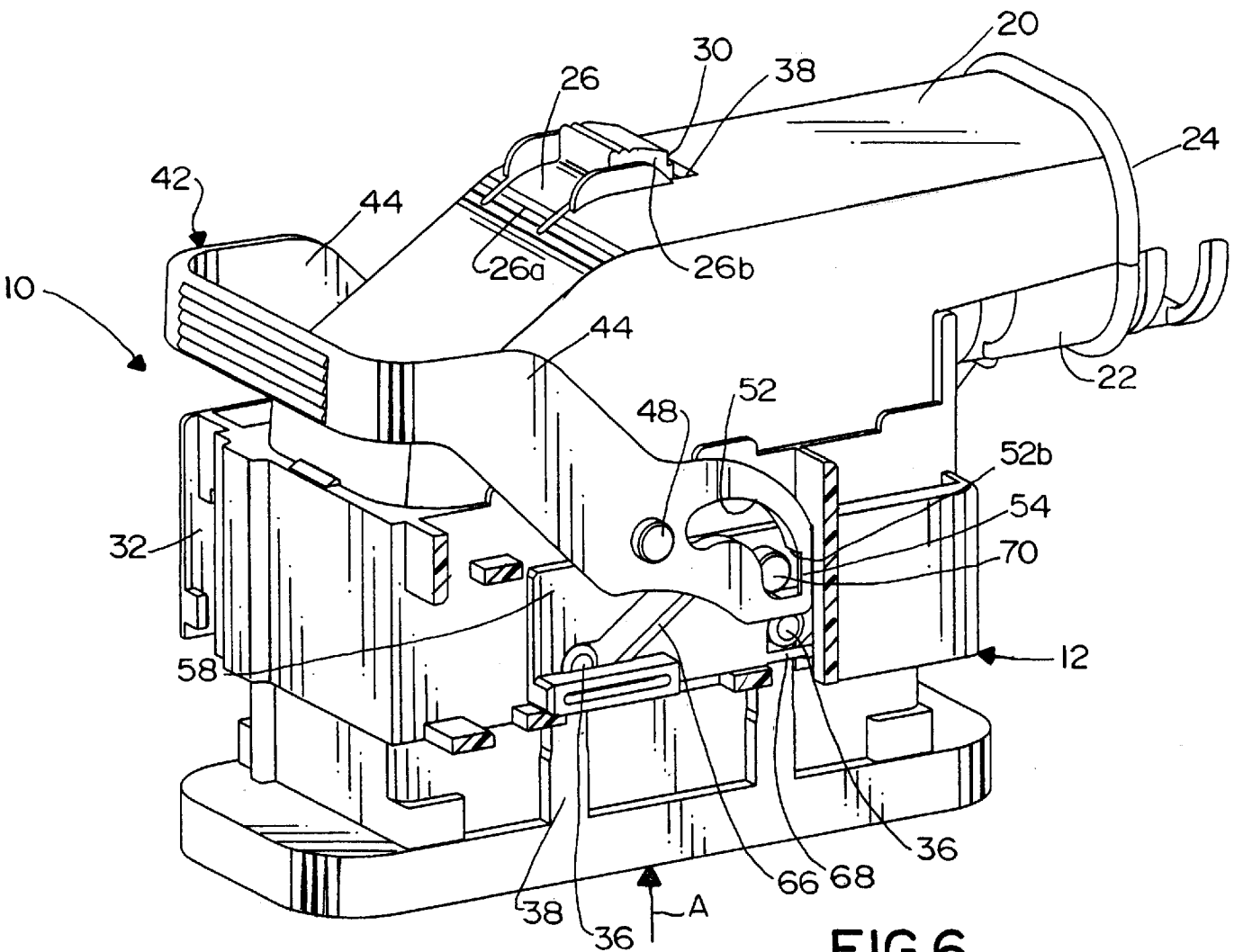
FIG. 6 is a perspective view of the connector assembly in pre-mated condition and with the outer side wall of the actuator connector broken away to show the position of the slide members.

FIG. 6 shows a pre-mated position cf mating connector 14 with actuator connector 12, and with lever structure 42 in an inoperative position. When in the inoperative position of the lever structure, cam follower projections 70 of slide members 58 are disposed in mouths 52*b* of cam grooves 52 in actuating arms 44 of the lever structure. When mating connector 14 is moved in the direction of arrow "A" (FIGS. 2 and 6), cam follower posts 36 snap behind detent ribs 68 which span the open mouths of cam grooves 66 in the slide members. These detent ribs are effective to hold mating connector 14 in a pre-mated position with actuator connector 12 as seen in FIG. 6, so that an operator can easily manipulate and rotate lever structure 42 without concern that the mating connector will become disengaged from the actuator connector. Similarly, during assembly of the actuator connector, cam follower projections 70 of the slide members snap behind detent ribs 54 to hold the slide members in assembly behind support walls 32 and interengaged with the lever structure.

Figure 7:
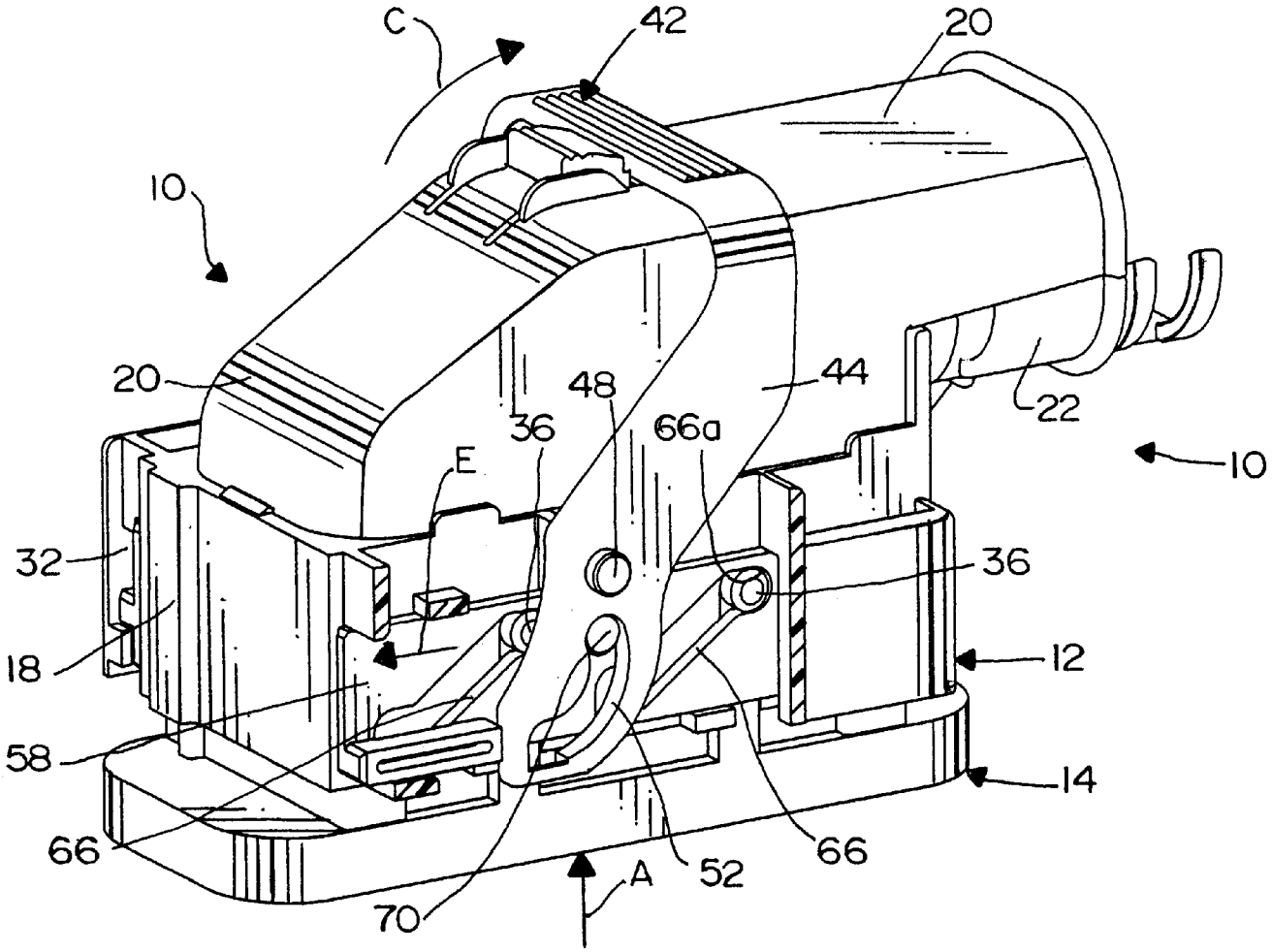
FIG. 7 is a view similar to that of FIG. 6, with the assembly in its mated condition and with the outer side wall again broken away to show the mated position of the slide members.

FIG. 7 shows lever structure 42 having been pivoted in the direction of arrow "C" to its fully operative position whereby cam grooves 52 drive slide members 58 in the direction of arrow "E", as cam follower projections 70 on the slide members move in cam grooves 52. In other words, pivotal or rotational movement of the lever structure effects linear or translational movement of the slide members. As the slide members move in the direction of arrow "E", mating connector 14 is drawn in the direction of arrow "A", into full mated position with actuator connector 12, as cam follower posts 36 are forced to move along cam grooves 66 toward closed ends 66*a* thereof. When lever structure 42 reaches its final, fully mated position, cross portion 46 of the lever structure snaps behind latch shoulder 30 of flexible arm 26 of shroud 20. This locks the lever structure in its final position and, thereby, locks the two connectors in their fully mated condition. When it is desired to unmate the connectors, distal end 26*a* of launch arm 26 is depressed to allow the lever structure to be rotated opposite the direction of arrow "C" back to its inoperative position shown in FIGS. 1 and 6. This forces cam follower projections 70 of slide members 58 back along cam grooves 52 and forces cam follower posts 36 of mating connector 14 back along cam grooves 66 of the slide members. The connectors then can be unmated by snapping the cam follower posts over detent ribs 68 at the mouths of cam grooves 66.

Finally, referring back to FIG. 4, it can be seen that polarizing ribs 64 which project outwardly of slide members 58 are located at different vertical positions on the respective slide members and which project into differently positioned recesses 80 in the inside of support walls 32. In other words, a pair of tongue-and-groove polarizing means of different configurations are provided to ensure that the right and left hand slide members are properly mounted on their respective proper sides of the actuator connector.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A lever type electrical connector assembly, comprising:

a first connector;

an actuating lever pivotally movably mounted on the first connector and including a first cam groove formed therein;

a slide member linearly movably mounted on the first connector and including a second cam groove formed therein, the slide member having a first cam follower projection engaged in the first cam groove of the actuating lever whereby pivotal movement of the actuating lever relative to the first connector effects linear movement of the slide member relative to the first connector; and a second connector having a second cam follower projection to be engaged in the second cam groove of the slide member whereby the connectors are mated and unmated in response to rotation of the actuating lever and resulting translation of the slide member.

2. The lever type electrical connector assembly of claim 1 wherein said actuating lever includes a pair of pivot bosses on opposite sides thereof engageable in a pair of pivot journals on the first connector.

3. The lever type electrical connector assembly of claim 1 wherein said first connector includes a housing and a support wall spaced outwardly of the housing with the actuating lever and the slide member disposed therebetween.

4. The lever type electrical connector assembly of claim 1 wherein said actuating lever comprises one actuating arm of a generally U-shaped lever structure having a pair of actuating arms pivotally mounted on opposite sides of the first connector and including a pair of said slide members on opposite sides of the first connector.

5. The lever type electrical connector assembly of claim 1 wherein the second cam groove in said slide member includes a mouth with a detent for capturing the second cam follower projection in a pre-mated position of the second connector.

6. The lever type electrical connector assembly of claim 1 wherein said slide member includes a pair of said second cam grooves spaced laterally of the mating direction of the connectors and engageable by a pair of said second cam follower projections on the second connector.

7. The lever type electrical connector assembly of claim 6 wherein said second cam grooves are generally parallel to each other and oblique to the linear direction of movement of the slide member.

8. The lever type electrical connector assembly of claim 1, including a pair of said actuating levers and a complementary pair of slide members on opposite sides of the first connector, and including complementary interengaging polarizing means between the slide members and the first connector to ensure that the proper slide member is mounted on the proper side of the first connector.

9. The lever type electrical connector assembly of claim 8 wherein said polarizing means comprise tongue-and-groove means of different configurations.

10. A lever type electrical connector assembly, comprising:

a first connector including a housing and a support wall spaced outwardly of each side of the housing;

a generally U-shaped lever structure having a pair of actuating arms pivotally mounted on opposite sides of the first connector between the housing and the outwardly spaced support walls thereof, each actuating arm including a first cam groove formed therein;

a slide member linearly movably mounted on the first connector between the housing and each of the outwardly spaced support walls thereof, each slide member including a second cam groove formed therein, each slide member having a first cam follower projection engaged in the first cam groove of a respective one of the actuating arms, whereby pivotal movement of the lever structure relative to the first connector effects linear movement of the slide members relative to the first connector; and a second connector having a second cam follower projection on each opposite side thereof to be engaged in the second cam groove of a respective one of the slide members, whereby the connectors are mated and unmated in response to rotation of the lever structure and resulting translation of the slide members.

11. The lever type electrical connector assembly of claim 10 wherein each actuating arm of the lever structure includes a pair of pivot bosses on opposite sides thereof engageable in pivot journals on the housing and the respective support wall of the first connector.

12. The lever type electrical connector assembly of claim 10 wherein the second cam grooves in said slide members include mouths with detents for capturing the second cam follower projections in a pre-mated position of the second connector.

13. The lever type electrical connector assembly of claim 10 wherein each of said slide members includes a pair of said second cam grooves spaced laterally of the mating direction of the connectors and engageable by a pair of said second cam follower projections on the second connector.

14. The lever type electrical connector assembly of claim 13 wherein said second cam grooves are generally parallel to each other and oblique to the linear direction of movement of the slide members.

15. The lever type electrical connector assembly of claim 10, including complementary interengaging polarizing means between the slide members and the first connector to ensure that the proper slide member is mounted on the proper side of the connector.

16. The lever type electrical connector assembly of claim 15 wherein said polarizing means comprise tongue-and-groove means of different configurations.

* * * * *